US006016789A

United States Patent [19]

Denz et al.

[11] Patent Number: 6,016,789

[45] Date of Patent: Jan. 25, 2000

[54] APPARATUS FOR CONTROL OF AN INTERNAL COMBUSTION ENGINE, ESPECIALLY FOR CONTROL OF FUEL INJECTION AND IGNITION

[75] Inventors: Helmut Denz, Stuttgart; Klaus Walter, Bietigheim-Bissingen, both of Germany

[73] Assignee: Robert Bosch GmbH, Stuttgart, Germany

[21] Appl. No.: 08/984,686

[22] Filed: Dec. 3, 1997

[30] Foreign Application Priority Data

Dec. 4, 1996 [DE] Germany ..... 196 50 250

[51] Int. Cl.[7] ..... F02P 7/067

[52] U.S. Cl. ..... 123/406.62; 123/643

[58] Field of Search ..... 123/406.47, 406.62, 123/406.63, 643

[56] References Cited

U.S. PATENT DOCUMENTS

| | | | |
|---|---|---|---|
| 5,267,544 | 12/1993 | Ohkumo et al. | 123/643 |
| 5,269,274 | 12/1993 | Flaetgen et al. | 123/406.62 |
| 5,619,968 | 4/1997 | Hillsberg et al. | 123/406.62 |
| 5,671,145 | 9/1997 | Krebs et al. | 123/406.62 |
| 5,671,714 | 9/1997 | Fukui et al. | 123/406.62 |

FOREIGN PATENT DOCUMENTS

| | | | |
|---|---|---|---|
| 203 357 | 10/1983 | Germany | 123/109 |
| OS 43 27 218 | 8/1993 | Germany . | |
| WO 90/15245 | 12/1990 | WIPO | 123/109 |

*Primary Examiner*—Erick R. Solis
*Attorney, Agent, or Firm*—Michael J. Striker

[57] ABSTRACT

The apparatus for controlling an internal combustion engine, especially a V-motor with a camshaft for each cylinder bank, includes a signal transmitter with a transmitter wheel having an angle mark extending over 180° for each camshaft. A signal transmitter including a transmitter wheel having a plurality of angle marks and at least one reference mark is attached to the crankshaft of the internal combustion engine. The control device determines the operating configuration of the engine and/or performs a cylinder analysis from the produced transmitted signals. Also an emergency operation can be performed and a reverse rotation detected and, if necessary, a camshaft displacement can be determined.

11 Claims, 2 Drawing Sheets

APPARATUS FOR CONTROL OF AN INTERNAL COMBUSTION ENGINE, ESPECIALLY FOR CONTROL OF FUEL INJECTION AND IGNITION

BACKGROUND OF THE INVENTION

The present invention relates to an apparatus for control of an internal combustion engine, especially for control of the fuel injection and ignition processes and, more particularly, to an apparatus for control of an internal combustion engine comprising a computer in which the angular position of the crankshaft and camshaft is determined by analysis of suitable transmitted signals in order to form a control signal for the injection valves and/or for activating ignition events, in which a crank shaft transmitter wheel with at least one reference mark connected with the crankshaft for production of transmitted signals and a camshaft transmitter wheel with an angle mark extending over 180° connected with the camshaft are each monitored by a receiver.

When and how much fuel should be injected per cylinder and the time for ignition events are calculated in a multicylinder internal combustion engine with electronically controlled injection and ignition. So that these computations can be performed in the correct manner, the respective positions of the crankshaft and/or the camshaft or the camshafts of the internal combustion engines must be known. Because of that, as described in German Published Patent Application DE-OS 43 27 218 the crankshaft and camshaft are each connected with a transmitter wheel which has a characteristic surface and is monitored by a receiver. The crankshaft transmitter wheel has a plurality of similar angle marks, which are equally spaced from each other and a reference mark formed by the omission of two angle marks. The camshaft transmitter wheel has a single angle mark, which extends over an arcuate region of 180°. Both transmitter wheels are monitored with the aid of a suitable receiver, whose output signals are analyzed in a control unit or controller.

According to the internal operation of the internal combustion engine the angular positions of the crankshaft and camshaft are not known to the controller. When both shafts have rotated about a predetermined angle and the reference mark and at least one angular mark side of the camshaft is detected, a synchronization can occur and the control pulses for the injection event and the ignition event in the proper phase relationship can be generated and transmitted.

SUMMARY OF THE INVENTION

It is an object of the present invention to provide an improved apparatus for control of an internal combustion engine, especially for control of the fuel injection and ignition events.

According to the invention, the apparatus for controlling operation of an internal combustion engine having a crankshaft and a first and second camshaft, especially for controlling the ignition and fuel injection systems, comprises means for processing transmitted signals containing information regarding respective angular positions of the crankshaft and the camshafts to form at least one control signal for at least one of the injection valves and activating ignition events, and means for producing the transmitted signals including a crankshaft signal transmitter comprising a crankshaft transmitter wheel attached to the crankshaft, the crankshaft transmitter wheel having at least one reference mark thereon, a first camshaft signal transmitter comprising a first camshaft transmitter wheel having an angle mark extending over 180° attached to the first camshaft and a second camshaft signal transmitter comprising a second camshaft transmitter wheel having an angle mark extending over 180° attached to the second camshaft, the transmitter wheels attached to the crankshaft and the first camshaft being oriented at an angle $\alpha 1$ with respect to each other and the transmitter wheels attached to the crankshaft and the second camshaft being oriented at an angle $\alpha 2$ with respect to each other.

The apparatus for control of an internal combustion engine according to the invention has the advantage that an especially rapid synchronization is possible in an internal combustion engine with two camshafts, since six well-defined synchronization points are produced by the arrangement and form of the transmitter wheels on the crankshaft and camshafts according to the invention during the operation of the internal combustion engine. The apparatus according to the invention may especially preferably be used for cylinder monitoring in internal combustion engines with V-shaped cylinder arrangements, in which the cylinders are arranged in two cylinder banks and a camshaft including an associated transmitter wheel is associated with the respective cylinder banks.

Various preferred embodiments of the invention are possible. Thus it is especially advantageous when the synchronization between the camshaft and crankshaft can occur, on the one hand, at the reference mark and/or the gap on the crankshaft transmitter wheel with the associated phase level of the camshaft signals in the cylinder bank 1 or 2 or by synchronization at the positive or negative camshaft edge in the cylinder bank 1 or 2. A phase transmitter emergency procedure can be initiated on breakdown of one of the camshaft phase transmitters, in which a synchronization can then only occur with the remaining camshaft phase signals, whereby always four well-defined synchronization points are maintained.

During failure of the crankshaft rotation speed transmitter, which the transmitter wheel rotating with the crankshaft detects, four well-defined synchronization points are still obtained since positive or negative camshaft transmitter wheel edges from the cylinder bank 1 or 2 are detected and the corresponding signals processed. Furthermore in an advantageous manner four edges are obtainable for determination of the motor position or configuration in rotation speed transmitter emergency operation.

In case the motor runs in reverse a reverse rotation detection occurs in an advantageous manner so that the danger of a backfire is reduced. During reverse rotation of the motor the positive and negative pulse edges of advantageously rectangular pulse signals from the respective camshaft signal transmitters are shifted about 180° KW so that that may be prevented during reverse operation of the motor.

An advantageous signal processing is possible in an internal combustion engine with variable camshaft displacement or for testing camshaft displacement, since two signal pulse sides or edges exist pre cylinder head with which the actual value of the camshaft displacement can be determined. This actual value can be used for the control of the constant camshaft displacement or for testing for camshaft shifts.

It is particularly advantageous that two mechanically similar transmitter wheels which rotate in different directions may be used for camshaft transmitter wheels. This provides the advantage that only one type of transmitter wheel needs to be manufactured so that there is no danger of an exchange resulting in incorrect installation. The entire apparatus can be used as a fast-start system in an advantageous manner.

BRIEF DESCRIPTION OF THE DRAWING

The objects, features and advantages of the present invention will now be illustrated by the following description of preferred embodiments with reference to the accompanying drawing in which.

DESCRIPTION OF THE PREFERRED EMBODIMENTS

Figure 1:
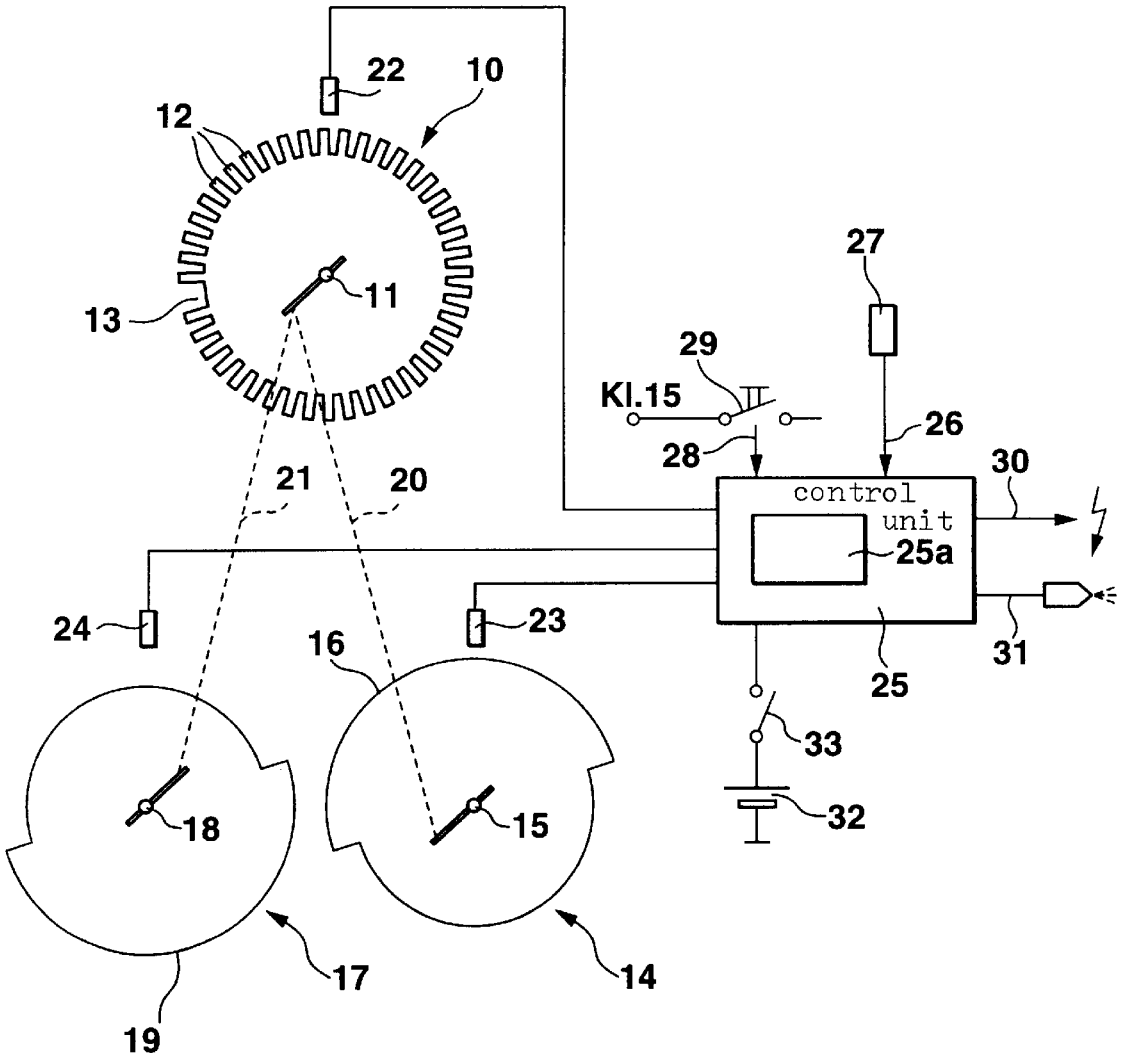
FIG. 1 is a gross diagrammatic overview of an arrangement of camshafts and crankshaft together with their associated sensing receivers and control unit in which processing for control of the ignition events and injection events takes place.

The parts of an internal combustion engine required for explanation of the invention are illustrated in FIG. 1, including a transmitter wheel 10 which is part of a crankshaft signal transmitter and is rigidly connected with the crankshaft 11. This transmitter wheel 10 has a plurality of similar angle marks 12 arranged around its circumference. A reference mark 13, which is provided by the omission of two angle marks, is present on it in addition to the similar angle marks 12. The number of the angle marks amounts, for example, to 60-2.

A first transmitter wheel 14, which is part of a first camshaft signal transmitter is connected with the first camshaft 15 of the internal combustion engine and has an angle mark 16 on its periphery which extends over an angle of 180°. A second transmitter wheel 17 is connected with the second camshaft 18 of the internal combustion engine and has an angle mark 19 on its circumference which extends over an angle of 180°. The connections between the crankshaft and camshafts are designated with the reference numbers 20 and 21. Both camshafts are thus driven by the crankshaft so that they rotate with half the crankshaft angular speed. In a motor in which the cylinders are arranged in a so-called V-arrangement (V-motor) one camshaft is associated with one cylinder bank and the other camshaft is associated with the other cylinder bank.

For other internal combustion engines which have several camshafts per cylinder bank, the apparatus according to the invention can also be used. For example, in an internal combustion engine with variable camshaft displacement or shift in which one camshaft is present for injection valve control and another is present for exhaust valve control, the camshaft displacement or shift may be determined with the apparatus according to the invention.

The apparatus according to the invention can generally be used in motors with at least two camshafts, in which the camshafts are usually inlet valve camshafts and exhaust valve camshafts.

Figure 2:
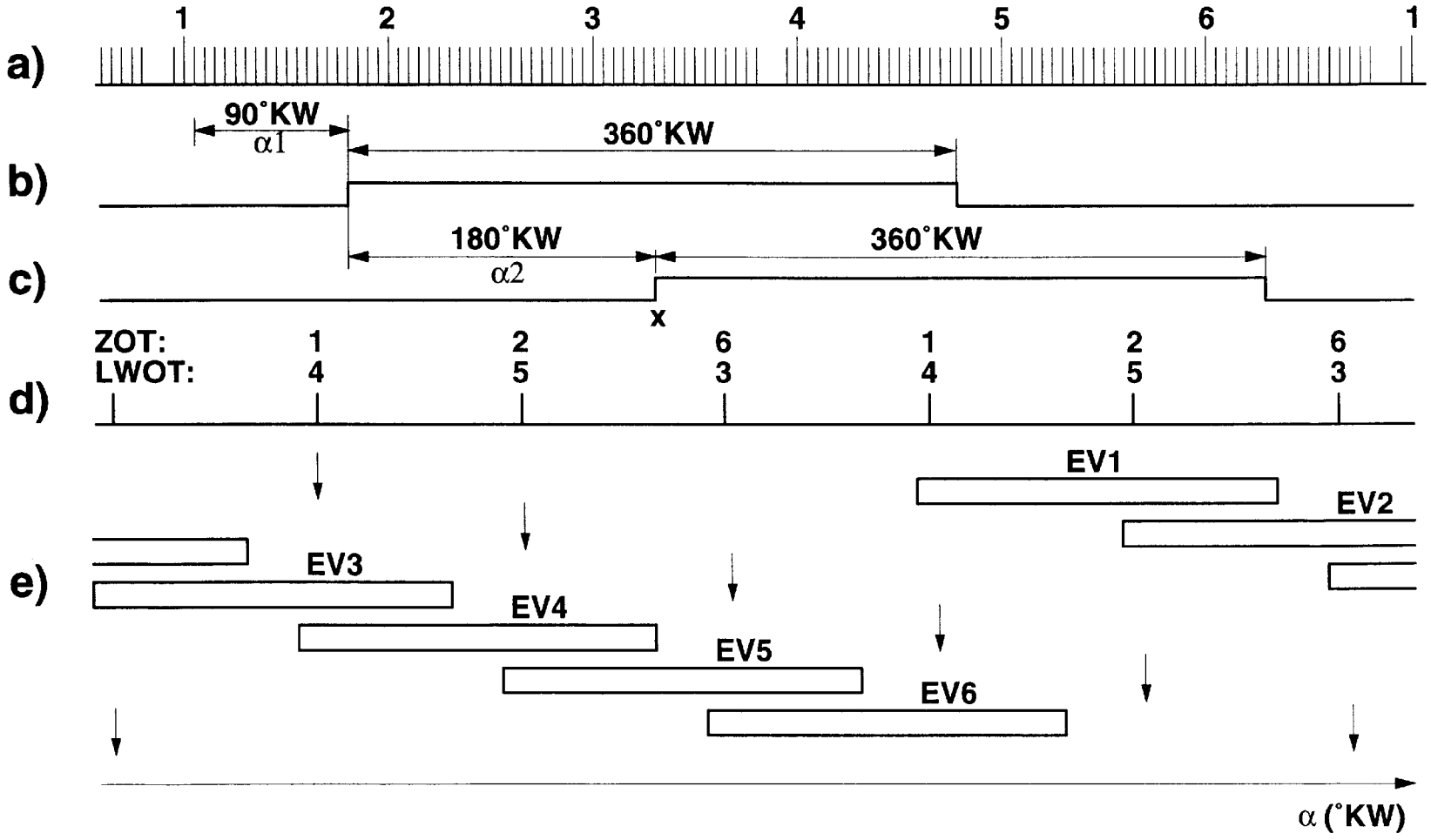
FIG. 2 is a timing diagram showing signal behavior over the crankshaft angle.

In the embodiment shown in FIG. 1 the arrangement of the transmitter wheels associated with the crankshaft and camshafts is such that the signal behavior shown in FIG. 2 results. In this embodiment the first camshaft transmitter wheel is rotated about an angle $\alpha 1$ relative to the crankshaft. The second camshaft transmitter wheel is rotated about an angle $\alpha 2$ relative to the first camshaft. The angle $\alpha 2$ is preferably about 180°. The angle $\alpha 1$ is about 45°, whereby the angle is measured between the beginning, i.e. the leading edge in the rotation direction, of the angle mark 16 and the end of the reference mark 13. Then the signal course is summarized in FIG. 2.

The transmitter wheels 10, 14, 17 associated with the crankshaft and the camshafts are detected with the help of suitable sensing receivers 22, 23, 24, for example inductive receivers or Hall sensors, whose signals produced during passage of the angle marks past them are either prepared and input to a control unit or controller 25 or prepared in the control unit 25 itself in a suitable manner. Rectangular pulse signals are advantageously formed in this preparation, whose ascending sides correspond to the beginning of the corresponding angle marks and whose falling sides to the end of the corresponding angle marks. These signals and/or the time sequence of the pulses of the signals are analyzed in the control unit 25 to determine rotational speed and angular position of the shafts.

The control unit 25 has a number of different inputs for the input variables, of which only the input 26 is shown in the drawing, required for control of the internal combustion engine which are measured by different sensors 27. Examples of these sensors include: a motor temperature sensor, a throttle valve sensor, an exhaust pipe pressure sensor and so forth. Also an ignition-on signal is input via an input 28 which is provided on closing of the ignition switch 29 of the terminal KI.15 of the ignition lock.

The control unit provides at its output side, which includes processor and memory means not illustrated in detail, signals for the ignition and injection which are indicated with 30 and 31 respectively. The power supply of the control unit 25 occurs in the standard way with the help of a battery 32 which is connectable with a switch 33 with the control unit 25. The control unit 25 determines the position of the crankshaft 11 and the camshafts 15, 18 at each time during operation of the internal combustion engine with the help of the variables illustrated in FIG. 1. Since the relationship between the crankshaft 11 and the camshafts 15, 18 is likewise known like the relationship between the position of the camshafts and the position of the individual cylinders, after the detection of a first synchronization point the synchronization and/or cylinder detection can occur and the injection and ignition can be controlled and/or regulated in a known manner.

In FIG. 2 the transmitted signals supplied by the sensing receivers 22, 23, 24 already process into rectangular pulse signals which are evaluated in the control unit 25 are produced over the crankshaft angle $\alpha$ in KW°. The signals supplied by the crankshaft transmitter wheel 10, which occur when a wheel with 60-2 angle marks is used as transmitter wheel, are shown individually in FIG. 2*a*. The reference mark, which is formed by two omitted pulses, occurs once per revolution of the crankshaft, also twice per operating cycle. The number sequence 1 to 6 indicates six synchronization points whose determinationis explained in more detail in the following.

Both signals produced by the camshaft transmitters are illustrated in FIGS. 2*b* and 2*c*. The length of a "High" and a "Low" phase respectively amounts to 360° KW, since the camshaft rotates with half the speed of the crankshaft. The angle $\alpha 1$ with reference to the crankshaft amounts to 90° KW, which corresponds in fact to an angle of 45°.

In FIG. 2*d* which cylinder is in an ignition upper dead point (ZOT) according to a software internal counting method is given, also which cylinder is in a load cycle upper dead point (LWOT).

In FIG. 2*e* the open stage or phase of each inlet valve (EV1, EV2, . . . ) for the individual cylinders is shown and the arrows indicate the ignition time points.

The signal behavior shown in FIG. 2 is, as already mentioned, obtained, when a six cylinder V-motor with two camshafts each having a transmitter wheel with a 180° long angle mark is used, in which the position of both transmitter wheels is shifted relative to each other by about the angle $\alpha 2$ advantageously 90° NW, corresponding to 180° KW, in the operating cycle. The position of the segment change relative to the synchronization points on the crankshaft, which is shown going from the second angle mark after the 60-2 gap, is shifted about a definite angle $\alpha 1$, advantageously 45° NW and/or 90° KW, in the operating cycle.

Two independent inputs are available for both camshaft transmitter signals for the signal reception in the control unit 25 which also includes a means 25*a* for scanning for pulse side of both camshaft transmitter signals separately besides the normal level pick-off.

Six well-defined synchronization points are produced in the operating cycle (720° KW) with this arrangement. A synchronization can occur at the reference mark (gap) in the crankshaft signal using the phase values of the camshaft signal 1 or 2 which is associated with cylinder bank 1 or 2. Additional synchronization may be performed at a positive or negative side of the camshaft signal of cylinder bank 1 or 2. In as much as six synchronization points are defined, a comparatively fast start can occur with the above-described system, since a synchronization can be performed after reaching the first of the six synchronization points.

In the event that one of the two camshaft phase transmitters 23, 24 is defective, four well-defined synchronization points still always are produced, because the remaining phase transmitter signal is analyzed or processed together with the crankshaft transmitter signal. The gap in the crankshaft signal and the occurrence of a positive or negative side or edge of a camshaft transmitter signal pulse is thus again evaluated.

In the event that the rotational speed transmitter, also the crankshaft transmitter 22 is defective or fails, four well-defined synchronization points may be produced by analysis of the positive or negative sides of both pulsed camshaft transmitter signals. In the case of the so-called speed transmitter emergency procedure four sides for determination of the motor configuration are always still available during emergency operation.

A reverse rotation detection is also possible with the apparatus according to the invention. When the motor is in reverse, for example after choking, there is a danger that a so-called exhaust pipe backfire can occur. Both camshaft transmitter signals may be detected when the side change has been shifted about 180° KW in reverse. When this shift is detected, the required measures can be taken by the control unit 25 during required measures can be taken by the control unit 25 during reverse of the motor. Additional injection events can be suppressed when a reverse is detected so that the motor comes to a stop comparatively quickly.

The actual value of the camshaft shift may be measured with the help of the apparatus according to the invention in an engine with variable camshaft displacement or in an analysis of camshaft displacement, since the time sequence of the signal sides of both camshaft transmitter signal pulses with respect to each other is set. Two pulse signal sides are present per cylinder head, by which the actual value of the displacement can be measured. This actual value may be used for control of the constant displacement or the diagnoses.

The disclosure of German Patent Application 196 50 250.0 Dec. 4, 1996 is hereby incorporated herein by reference. This German Patent Application discloses the same invention described and claimed herein and provides the basis for a claim of priority nunder 35 U.S.C. 119.

We claim:

1. An apparatus for controlling operation of an internal combustion engine, said internal combustion engine having a crankshaft, a first camshaft, and a second camshaft, an ignition system in which ignition events occur during operation and a fuel injection system including injection valves for injecting fuel during operation, said apparatus comprising means (25, 25*a*) for processing transmitted signals containing information regarding respective angular positions of the crankshaft and the camshafts to form at least one control signal (30, 31) for at least one of the injection valves and activating ignition events, means for producing said transmitted signals including a crankshaft signal transmitter comprising a crankshaft transmitter wheel attached to the crankshaft, said crankshaft transmitter wheel (10) having at least one reference mark (13) thereon, a first camshaft signal transmitter comprising a first camshaft transmitter wheel (14) having an angle mark (16) extending over 180° attached to said first camshaft and a second camshaft signal transmitter comprising a second camshaft transmitter wheel (17) having an angle mark (19) extending over 180° attached to said second camshaft, wherein said transmitter wheels (10, 14, 17) attached to said crankshaft and said first camshaft are oriented at an angle $\alpha 1$ with respect to each other and said transmitter wheels attached to said crankshaft and said second camshaft are oriented at an angle $\alpha 2$ with respect to each other.

2. The apparatus as defined in claim 1, wherein said means (25,25*a*) for processing is a control device of the internal combustion engine, said angle $\alpha 1$ is measured between said reference mark of said crankshaft transmitter wheel and a leading edge of said angle mark on said first camshaft transmitter wheel, said angle $\alpha 1$ is substantially equal to 45° NW or 90° KW, said angle $\alpha 2$ is defined between said leading edge of said angle mark on said first camshaft transmitter wheel and a leading edge of said second crankshaft transmitter wheel and said angle $\alpha 2$ is substantially equal to 90° NW or 180° KW.

3. The apparatus as defined in claim 1, wherein the internal combustion engine is a V-motor including two cylinder banks and each of said cylinder banks is provided with one of said camshafts.

4. The apparatus as defined in claim 1, wherein the internal combustion engine includes at least said two of said camshafts including an inlet valve camshaft and an outlet or exhaust valve camshaft.

5. The apparatus as defined in claim 2, wherein said transmitted signals comprise a plurality of rectangular pulses having pulse sides, said control device includes independent inputs for said transmitted signals from said camshafts and said control device includes means (25*a*) for performing an interrupt scan for said pulse sides in each of said transmitted signals separately in addition to signal level pick-up.

6. The apparatus as defined in claim 1, wherein said means (25,25*a*) for processing includes means for defining a plurality of well-defined synchronization points including a first synchronization point based on said transmitted signals, means for performing a synchronization at said synchronization points and means for starting operation of the internal combustion engine on initial detection of the first synchronization point so that a comparatively fast starting of engine operation results.

7. The apparatus as defined in claim 6, wherein said means (25,25*a*) for processing includes means for detecting a failure of at least one of said crankshaft signal transmitter and said camshaft signal transmitters, and wherein said means for defining said well-defined synchronization points operates with remaining ones of said transmitted signals left after said failure.

8. The apparatus as defined in claim 2, wherein said transmitted signals comprise a plurality of rectangular pulses having positive and negative pulse sides and said control device includes means for measuring positive and negative pulse side shifts of said first and second camshaft transmitter signals with respect to each other and to detect a reverse rotation when said pulse sides of said first and second camshaft transmitter signals are shifted 180° KW with respect to each other.

9. The apparatus as defined in claim 1, wherein said camshafts have a constant displacement, and wherein said means for processing includes means for determining an actual value of said camshaft displacement by processing both of said transmitted signals from said camshafts and means for controlling said constant displacement of said camshafts with respect to each other using said actual value.

10. The apparatus as defined in claim 1, wherein said means for processing includes means for testing camshaft displacement of said first and second camshaft with respect to each other, means for determining an actual value of said camshaft displacement by processing both of said transmitted signals from said camshafts and means for controlling said camshaft displacement using said actual value.

11. The apparatus as defined in claim 10, wherein said transmitted signals comprise a plurality of rectangular pulses having positive and negative pulse sides and said means for determining said actual value of said camshaft displacement processes said positive and negative pulse sides of said transmitted signals per cylinder head.

* * * * *